United States Patent [19]

Wolff et al.

[11] 4,408,919

[45] Oct. 11, 1983

[54] CORN BUTTERING AND SALTING APPARATUS

[75] Inventors: Martin J. Wolff, North Providence; Joseph S. Falvo, Johnston, both of R.I.

[73] Assignee: Dart Industries Inc., Northbrook, Ill.

[21] Appl. No.: 310,297

[22] Filed: Oct. 9, 1981

[51] Int. Cl.[3] ..... A47G 21/06

[52] U.S. Cl. ..... 401/12; 401/171; 401/176; 401/195; 222/142.1

[58] Field of Search ..... 401/12, 171, 176, 179, 401/195; 222/142.1, 142.4, 142.5

[56] References Cited

U.S. PATENT DOCUMENTS

| | | |
|---|---|---|
| D. 157,183 | 2/1950 | Newell . |
| D. 159,748 | 8/1950 | Mossel . |
| D. 178,487 | 8/1956 | Becker . |
| D. 194,883 | 3/1963 | Mattar . |
| 1,097,465 | 5/1914 | Pratt . |
| 2,458,120 | 1/1949 | Volpini . |
| 2,527,149 | 10/1950 | Peterson . |
| 2,565,874 | 8/1951 | Mossel . |
| 2,690,657 | 10/1954 | Milewski . |
| 2,756,498 | 7/1956 | Wasser . |
| 2,811,844 | 11/1957 | Selmer . |
| 2,893,032 | 7/1959 | Selmer . |
| 3,735,487 | 5/1973 | Wojcik . |

*Primary Examiner*—Steven A. Bratlie

[57] ABSTRACT

Apparatus for selectably buttering and salting an article of food such as an ear of corn or the like. A separate butter receptacle and salt receptacle are pivotably interconnected with each other so that the salt receptacle can fit into an opening of the butter receptacle, thereby urging a chunk of butter through a dispensing opening to be spread onto the corn. After the corn is buttered, the buttering and dispensing apparatus may be inverted in position to salt the corn.

11 Claims, 12 Drawing Figures

CORN BUTTERING AND SALTING APPARATUS

FIELD OF INVENTION

This invention relates in general to butter and salt dispensing apparatus, and relates in particular to apparatus for applying butter and salt to a food article such as corn on the cob.

BACKGROUND OF THE INVENTION

Buttering a hot ear of corn can challenge the patience and dexterity of the most determined diner. The usual approach calls for using a conventional table knife to cut a pat of butter, and attempting to spread the butter over the ear of corn with the knife. As most persons realize, however, the butter pat is quickly softened or melted by heat from the ear of corn, so that the pat becomes awkward to manipulate and spread with a knife. The butter pat may slip off the ear of corn, not infrequently landing at an inopportune location on the diner's plate and in any case leaving the ear partially unbuttered. Consequently, butter is unevenly spread over the ear of corn or may be completely missing from part of the ear.

After the corn is finally buttered, many persons salt the buttered corn to their taste. Although a conventional salt shaker is effective for this purpose, the diner must first put down the buttering knife and then reach for the salt. Moreover, if the diner desires to add more salt after first tasting the buttered ear of corn, the diner must either grip the salt shaker with buttery fingers, leaving a messy shaker for the next person, or else first clean his or her hands before reaching for the salt.

Various devices have been suggested in the prior art for applying butter or salt to an ear of corn or the like. These art devices have generally proven themselves cumbersome, awkward or messy in practice, or have other practical shortcomings which have prevented any widespread acceptance of such devices.

SUMMARY OF INVENTION

The foregoing and other aids as well as the shortcomings of the prior art are overcome or substantially alleviated by the food buttering and salting apparatus of the present invention. Stated in somewhat general terms, the present apparatus includes a receptacle for receiving and dispensing a quantity of butter, and a second receptacle for receiving and dispensing a quantity of salt or the like. The butter dispensing receptacle and salt dispensing receptacle are configured to selectably fit together, and are movably interconnected so that the salt dispensing receptacle serves to urge the butter out of a dispensing opening associated with the butter receptacle. Once the corn or other article of food is thus buttered to taste from the butter receptacle, the apparatus is manipulated to place the salt receptacle in operative position relative to the ear of corn. The corn may then be salted to taste, with both buttering and salting being two parts of an operation requiring but one implement, namely, a corn buttering and salting apparatus according to the teachings of the present invention.

Stated somewhat more particularly, the butter receptacle has a butter receiving opening separate from the dispensing opening, and the salt receptacle has a wall portion which can push against butter through the butter receiving opening. The salt receptacle may thus telescopically fit into the butter receptacle, so as to urge the butter toward the butter dispensing opening. The butter receptacle and salt receptacle are pivotably attached to each other, allowing the relative positions of each receptacle as well as the overall position of the apparatus relative to an ear of corn to be easily manipulated by the user.

Stated even more particularly, a separate handle may be formed with each receptacle, with a hinge interconnection formed between remote ends of the handles. The hinge interconnection permits the butter receptacle and salt receptacle to be brought together in the foregoing telescopic relationship, while also permitting these parts to be separated for ease of cleaning or the like.

Accordingly, it is an object of the present invention to provide improved apparatus for buttering and salting an article of food such as an ear of corn or the like.

It is another object of the present invention to provide improved corn buttering and salting apparatus which provides a positive force for urging a quantity of butter onto an ear of corn.

It is yet another object of the present invention to provide a corn buttering and salting apparatus in which either buttering or salting may take place with but a single implement.

Other objects and advantages of the present invention will become more readily apparent from the following description of a preferred embodiment.

DISCLOSURE OF PREFERRED EMBODIMENT

Turning to the Figures, there is shown generally at 14 a buttering and salting apparatus according to a preferred embodiment of the present invention. This apparatus includes a butter receptacle 15 for receiving a quantity of butter to be dispensed, and a salt receptacle 16 for receiving a quantity of granular material such as salt, seasoning, or the like to be dispensed. The term "butter" is here used in a relatively broad sense to include nondairy spreads such as oleomargarine or the like, in addition to creamery butter.

Figure 1:
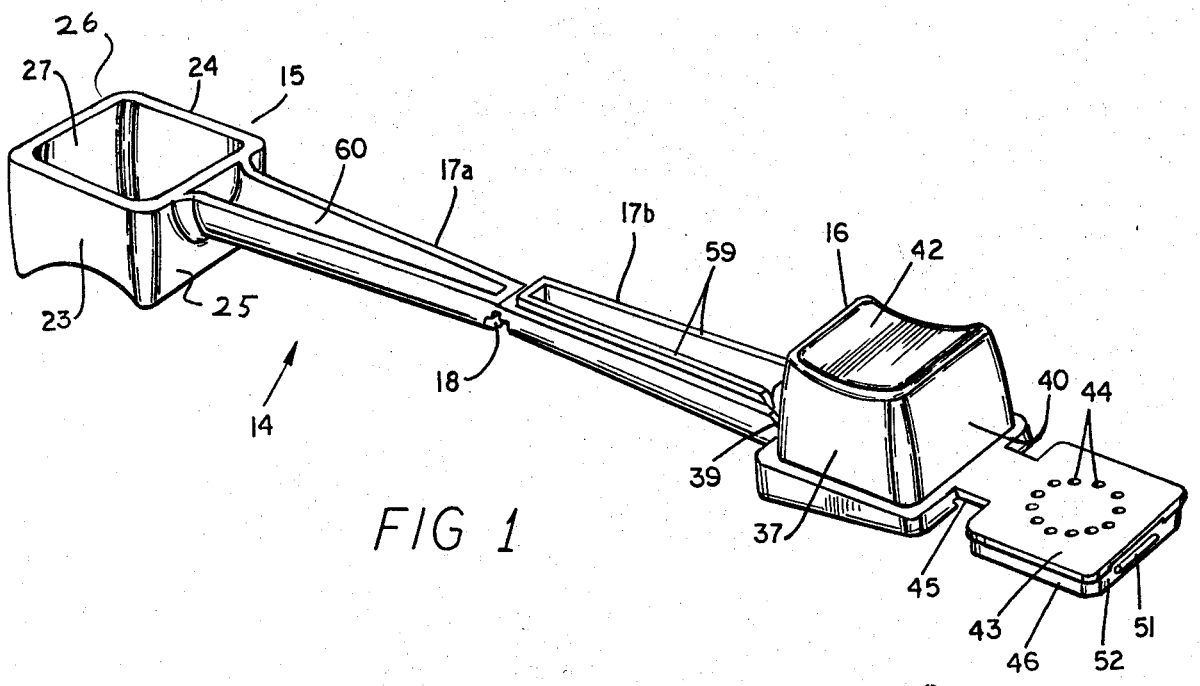
FIG. 1 is a pictorial view showing a corn buttering and salting apparatus according to a preferred embodiment of the present invention.
Figure 2:
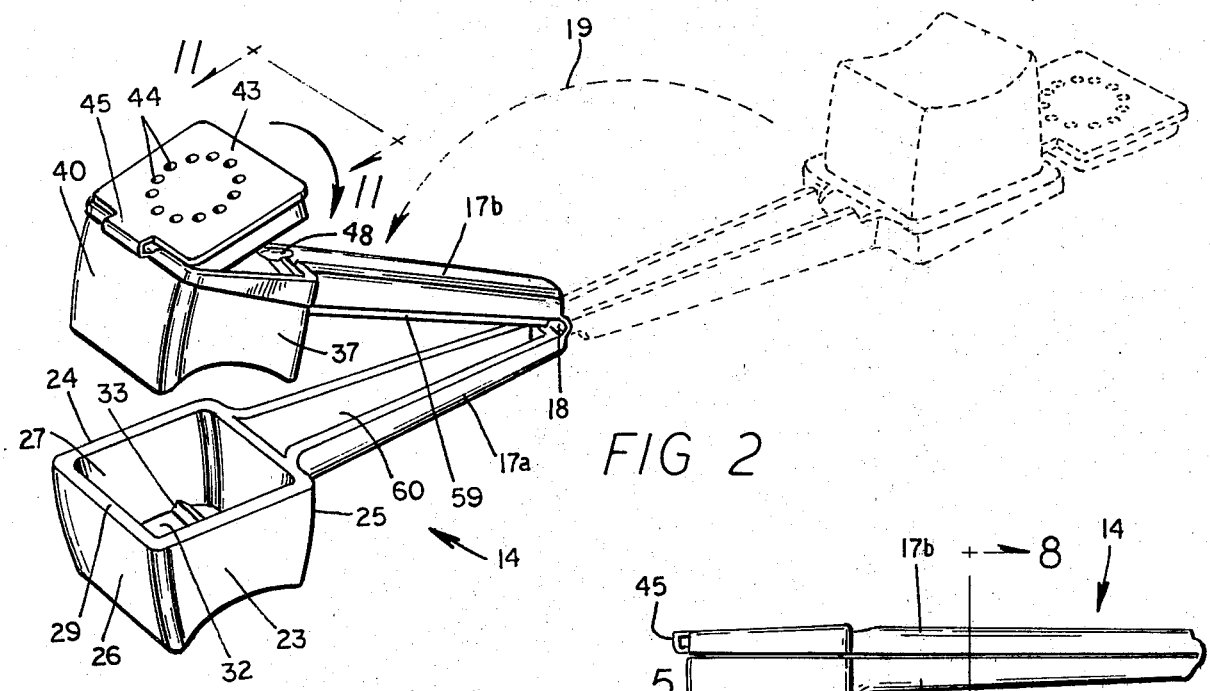
FIG. 2 is a pictorial view of the apparatus shown in FIG. 1, with open and partially-closed positions of the apparatus shown respectively by broken and solid lines.

Separate elongated handles 17*a* and 17*b* extend outwardly from the butter receptacle and salt receptacle, respectively, and the outer ends of these handles are joined together by the pivotable hinge interconnection 18. The entire apparatus 14 including the hinge interconnection 18 is preferably unitary, and may be formed by molding of a suitable plastic material. As is apparent from FIGS. 2 and 9, the handles 17*a* and 17*b* are approximately of equal length so that the salt receptacle 16 becomes located behind the butter receptacle 15 as the handles are folded back over each other pincers-style in the direction of broken arrow 19 in FIG. 2.

Figure 6:
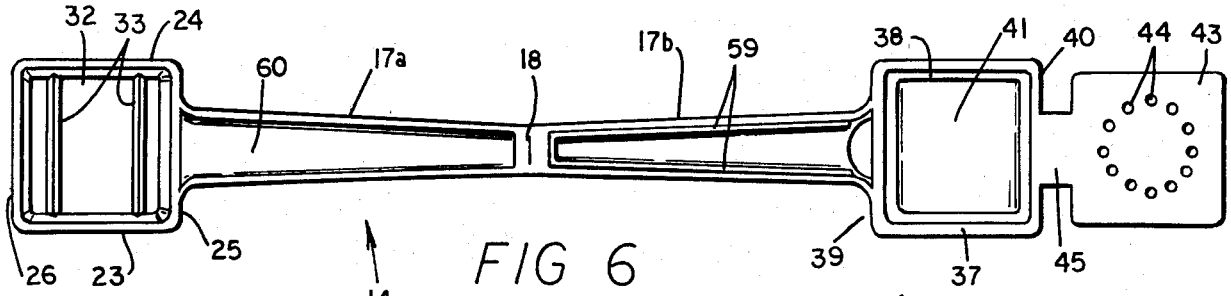
FIG. 6 is a top view of the apparatus as depicted in FIG. 1.

The butter receptacle 15 is defined by a pair of side walls 23 and 24, an inner wall 25 from which the handle 17*a* extends outwardly, and an outer wall 26. The four walls of the butter receptacle form a hollow interior butter-receiving receptacle 27. This butter receiving receptacle is generally square in cross-section shape as seen in FIG. 6, and is preferably configured to receive a chunk of butter 28 (FIG. 9) cut from a quarter-pound stick of butter. The butter compartment 27 includes an upper opening 29 for introducing the butter into the butter compartment.

Figure 4:
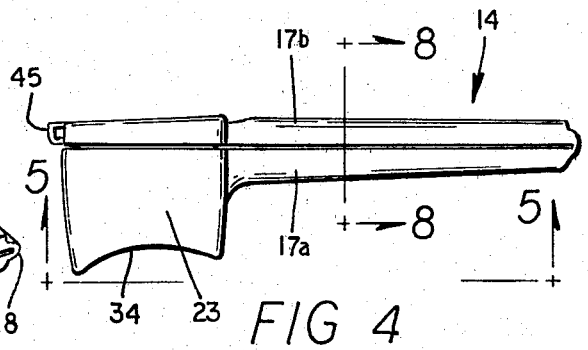
FIG. 4 is a side elevation view of the apparatus as depicted in FIG. 3.
Figure 5:
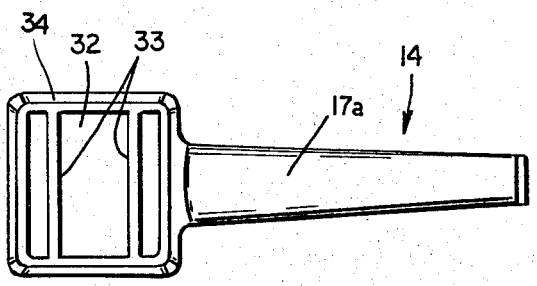
FIG. 5 is a bottom view taken along line 5—5 of FIG. 4.
Figure 7:
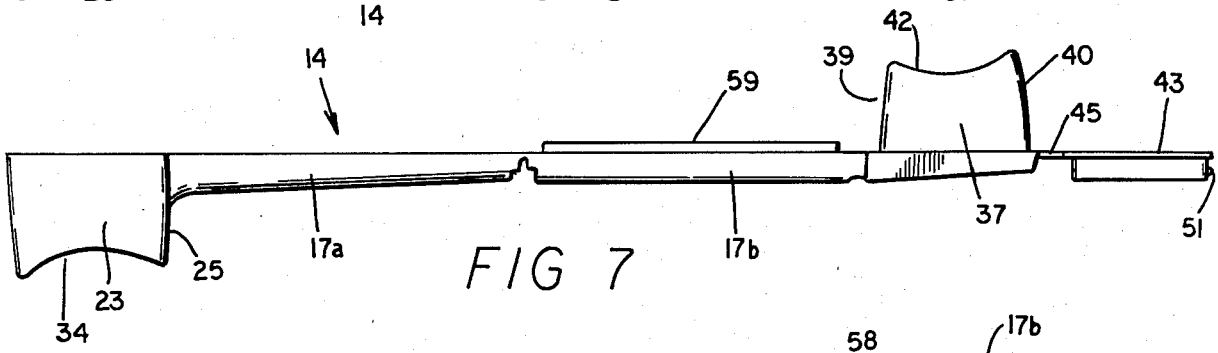
FIG. 7 is a side elevation view of the apparatus depicted in FIG. 6.
Figure 9:
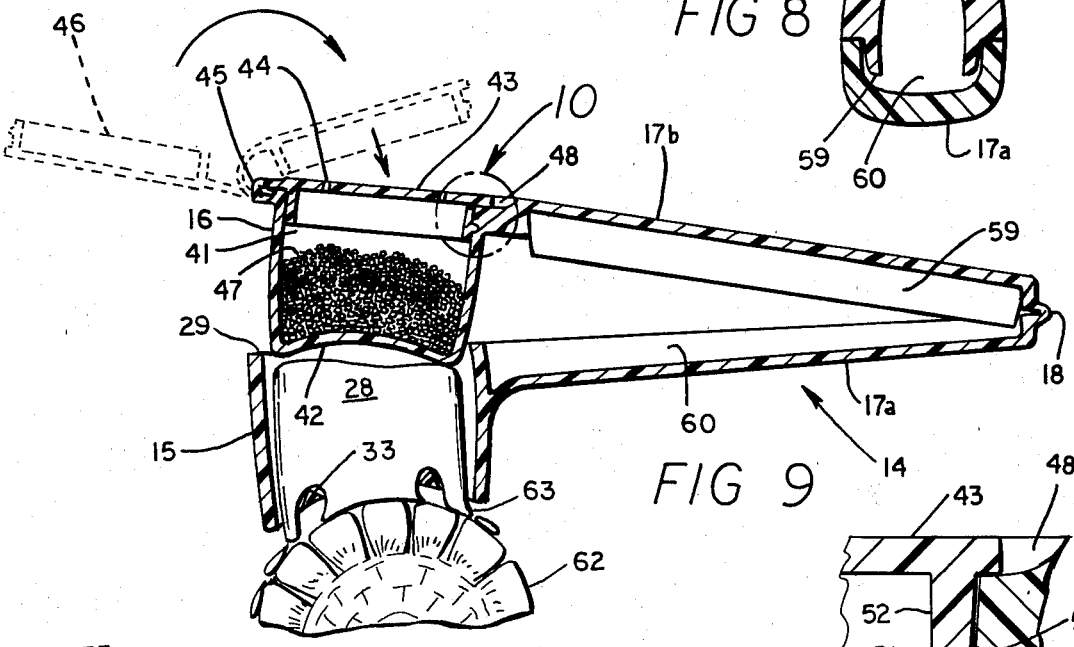
FIG. 9 is a sectioned elevation view showing the disclosed apparatus applying butter to an ear of corn.
Figure 12:
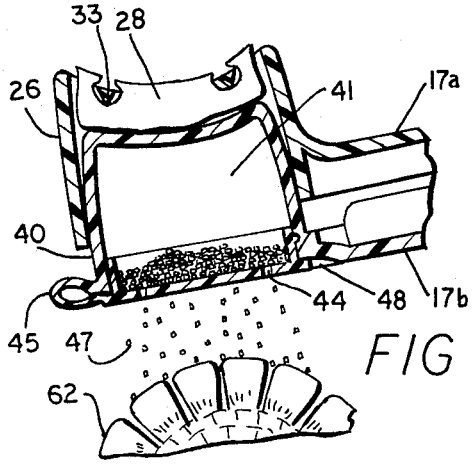
FIG. 12 is a fragmentary elevation view showing the present apparatus used for salting an ear of corn.
Figure 11:
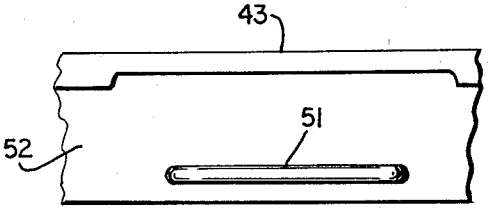
FIG. 11 is a fragmentary elevation view taken along line 11—11 of FIG. 2, showing details of the closure, lock in FIG. 10.

The butter compartment 27 has a butter dispensing opening 32, best seen in FIG. 5, and a pair of bars 33 span the butter dispensing opening. These bars 33 function to retain the chunk of butter 28 in place within the receptacle 27, as seen in FIGS. 9 and 12, and help promote an orderly flow of butter onto an ear of corn as discussed below in greater detail. The lower end 34 of each side wall 23 and 24 defining the butter receptacle 15 has an arcuate shape as best seen in FIGS. 4 and 7, generally conforming to the curvature of an ear of corn.

The salt receptacle 16 is formed by a pair of side walls 37 and 38, a rear wall 39 joined to the upwardly-extending handle 17*b*, and the outer wall 40. These walls together with the solid bottom wall 42 form a salt receiving compartment 41. The bottom wall 42 is preferably arcuate as shown in FIG. 7, having a curvature approximately the same as the curvature of the lower end 34 of the butter receptacle 15, as becomes more apparent below.

Figure 10:
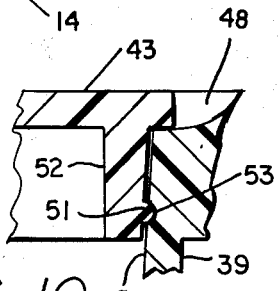
FIG. 10 is a fragmentary detail view of encircled portion 10 in FIG. 9, showing details of the closure lock for the salt compartment.

The salt receptacle 16 further includes a closure 43 having a number of salt-dispensing apertures 44 and connected to the outer wall 40 by the hinge 45, which preferably is an integral part of the overall molded unitary apparatus 14. The hinge 45 allows the closure 43 to occupy either an open position shown in phantom at 46 in FIG. 9, so that a quantity of salt or the like 47 can be placed into the salt compartment 41, or to be moved to the closed position shown in solid line in FIG. 9. The closure 43 is maintained in the closed position by means of a rib 51 formed on the outer surface of the closure wall 52, and by the mating longitudinal groove 53 formed in the confronting surface 54 of the salt receptacle rear wall 39. As best seen in FIG. 10, the groove 53 provides a detent to receive the rib 51 when the closure 43 fully closes the salt compartment 41. The finger recess 48 formed in the top of handle 17*b* facilitates opening the closure 43.

Figure 3:
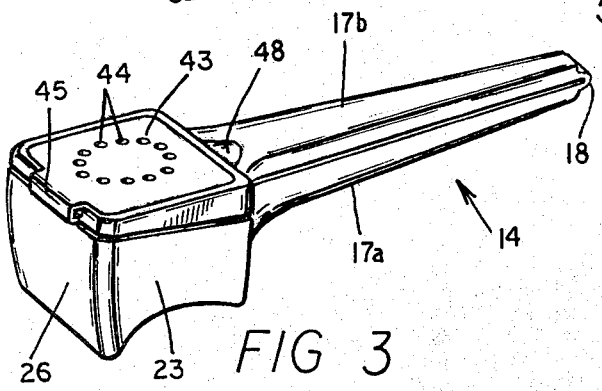
FIG. 3 is another pictorial view of the disclosed embodiment, shown in the fully closed position.
Figure 8:
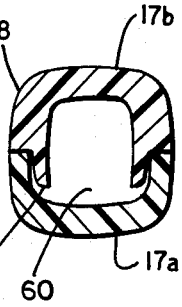
FIG. 8 is a section view through the folded handles of the present apparatus, taken along line 8—8 of FIG. 4.

Each handle 17*a* and 17*b* takes the shape of a hollow channel having exterior surfaces preferably lacking sharp edges when in the folded configuration shown in FIG. 3, for ease of handling. The handles 17*a* and 17*b* preferably have a generally U-shape exterior configuration as best shown in FIG. 8, so that the folded handles include relatively short-radius rounded corners 58 which assist the user in holding the apparatus. The handle 17*b* has a pair of flanges 59 flanking the interior channel and fitting within the slightly wider interior channel 60 of the handle 17*a*, as best seen in FIG. 8. The flanges 59 fitting within the channel 60 help keep the two handles 17*a* and 17*b* in alignment with each other, as the handles are pressed together.

The operation of the present apparatus is now described with particular reference to FIGS. 9 and 12. Shortly before the apparatus is put to use, a quantity of salt 47 is added to the salt compartment 41 and a chunk of butter 28 is added to the butter compartment 27. The buttering and salting apparatus 14 is now ready to spread butter on an ear of corn 62, (FIG. 9), simply by folding the handle 17*b* about the hinge 18 until the solid bottom wall 42 of the salt receptacle 16 contacts the end of butter chunk 28 through the upper opening 29 of the butter receptacle. The handles 17*a* and 17*b* are in the relative configuration shown in FIG. 9 at this time, and a person can easily grip both handles in one hand. By gently squeezing the handles 17*a* and 17*b* as so held, the bottom wall 42 of the salt receptacle forces the butter 28 downwardly toward the butter dispensing opening 32 of the butter receptacle, and the heat from the ear of corn 62 causes the butter to melt and flow past the bars 33 onto the corn as at 63. The apparatus 14 may be moved back and forth along the length of the corn, while the corn is held and rotated by the other hand in the conventional manner, thereby spreading a controllable layer of butter along the entirety of the corn. No salt escapes from the salt compartment 41 at this time, because the apertured closure 43 faces upwardly. The salt receptacle 16 becomes telescopically received into the butter compartment 27 as the butter 28 becomes depleted (FIG. 12) through continued use.

As soon as the corn is buttered to satisfaction, the apparatus 14 is easily inverted to the position shown in FIG. 12, placing the closure 43 with its salt dispensing apertures 44 facing downwardly above the corn. The entire apparatus 14, still held by one hand grasping the folded handles 17*a* and 17*b*, may now be gently shaken to dispense the desired amount of salt 47 onto the previously-buttered ear of corn 62.

If a person, after tasting the previously buttered and salted ear of corn, desires to add more salt, he or she can simply pick up the apparatus 14 in the inverted position of FIG. 12 and add more salt as desired. While this person's hands may be sticky from holding the buttered corn, this stickiness affects only the handles 17*a* and 17*b* of an apparatus which may be cleaned after each use. Thus, the existing conventional table salt shaker (which typically is not washed after each meal) is spared an unwanted and messy coating of butter from persons salting their buttered corn.

It should be apparent that the foregoing relates to but a preferred embodiment of the present invention, and that numerous changes and modifications may be made therein without departing from the spirit and scope of the present invention as defined in the following claims.

We claim:

1. Apparatus for applying butter and salt to an article such as an ear of corn or the like, comprising:

first means defining a butter receptacle having a butter receiving opening for receiving a quantity of butter or the like, and having a butter dispensing opening for dispensing the butter onto the article;

second means defining a salt receptacle for receiving a quantity of salt or the like;

means movably interconnecting said first means and second means and selectably movable either to a first position permitting butter to be inserted in said butter receiving opening, or to a second position entering said butter receiving opening to urge the butter toward said dispensing opening, so that said salt receptacle is operable to dispense butter from said butter receptacle; and a salt dispensing opening on said salt receptacle unobstructed by said butter receptacle while said salt receptacle remains in said butter receptacle.

2. Apparatus as in claim 1 wherein:

said salt receptacle comprises a portion selectably movable to enter said butter receiving opening, thereby to urge the butter toward said dispensing opening.

3. Apparatus as in claim 1, wherein:

said butter dispensing opening has an arcuate configuration for juxtaposition with an ear of corn to be buttered; and said salt receptacle is configured to fit telescopically into said butter receptacle through said butter receiving opening, so that butter in the butter receptacle is urged toward said butter dispensing opening as the salt receptacle is urged into the butter receptacle.

4. Apparatus as in claim 3, wherein:

said salt receptacle comprises an opening facing outwardly from said butter receiving opening as the salt receptacle is fitted therein;

closure means attached to said salt receptacle and removably covering said opening in the salt receptacle; and at least one salt dispensing aperture in said closure means, so that an ear of corn or the like can be buttered and then salted by urging the salt receptacle into the butter receptacle while applying said butter dispensing opening to the corn, and then inverting said apparatus to align the salt dispensing apparatus with the corn.

5. Apparatus as in claim 4, wherein said movable interconnecting means comprises hinge means interconnecting said butter receptacle and salt receptacle for relative movement on an arcuate path defining said telescopic fit of the salt receptacle into the butter receptacle.

6. Apparatus for buttering and salting an article of food such as an ear of corn or the like, comprising:

means defining a handle having a first portion and a second portion;

hinge means interconnecting said handle portions;

butter dispensing means disposed at a location on said first handle portion remote from said hinge means and operative to receive and dispense a quantity of butter or the like;

salt dispensing means disposed at a location on said second handle portion remote from said hinge means and operative to receive and dispense a quantity of salt or the like;

said butter dispensing means and said salt dispensing means being located in mutual juxtaposition when said first and second handle portions are folded along said hinge means; and means associated with said salt dispensing means operative to dispense butter from said butter dispensing means with both said dispensing means juxtaposed, so that the food can be buttered and salted in sequence by said apparatus.

7. Apparatus as in claim 6, wherein:

said butter dispensing means comprises a receptacle including an opening for receiving a quantity of butter to be dispensed, and also comprises at least one dispensing opening;

said salt dispensing means comprises a receptacle having an exterior wall portion; and said salt receptacle is selectably movable to urge said exterior wall portion toward said butter receiving opening and into engagement with the butter received therein, thereby to urge the butter toward said dispensing opening.

8. Apparatus as in claim 7, wherein:

said exterior wall portion comprises the bottom wall of said salt receptacle; and said salt receptacle is operative to enter into said butter receiving opening, so as to urge said bottom wall against the butter therein.

9. Apparatus as in claim 8, wherein:

said salt receptacle comprises an opening in spaced apart relation to said bottom wall so as to be facing away from said butter receiving opening;

closure means selectably obstructing said opening; and at least one salt dispensing aperture formed in said closure means, whereby an article of food such as an ear of corn or the like can be buttered and then salted by first urging the salt receptacle into said butter receptacle while applying said butter dispensing opening to the corn, and then inverting said apparatus to dispense salt onto the corn.

10. Apparatus as in claim 6, wherein:

said salt dispensing means is configured to enter said butter dispensing means and urge the butter into application with the food article, as said first and second handle portions are folded over each other with both said dispensing means in mutual juxtaposition.

11. Apparatus as in claim 6, wherein:

said butter dispensing means comprises a butter dispensing outlet and said salt dispensing means comprises a salt dispensing outlet; and said butter and salt dispensing outlets being aligned in different radial directions on said handle portions, so that butter or salt dispensing outlets can be selectably applied to a food article by rotating the folded handle portions.

* * * * *